US010302061B2

(12) United States Patent
Terada

(10) Patent No.: US 10,302,061 B2
(45) **Date of Patent: *May 28, 2019**

(54) IGNITION APPARATUS FOR INTERNAL COMBUSTION ENGINE

(71) Applicant: DENSO CORPORATION, Kariya, Aichi-pref. (JP)

(72) Inventor: Kanechiyo Terada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/572,891

(22) PCT Filed: May 10, 2016

(86) PCT No.: PCT/JP2016/063915
§ 371 (c)(1),
(2) Date: Nov. 9, 2017

(87) PCT Pub. No.: WO2016/181971
PCT Pub. Date: Nov. 17, 2016

(65) Prior Publication Data

US 2018/0258901 A1 Sep. 13, 2018

(30) Foreign Application Priority Data

May 11, 2015 (JP) ..... 2015-096215

(51) Int. Cl.
*F02P 3/04* (2006.01)
*F02P 15/10* (2006.01)
(Continued)

(52) U.S. Cl.
CPC ..... *F02P 3/04* (2013.01); *F02P 9/002* (2013.01); *F02P 15/00* (2013.01); *F02P 15/008* (2013.01);
(Continued)

(58) Field of Classification Search
CPC .... F02P 3/04; F02P 9/002; F02P 15/10; F02P 15/08; F02P 15/008; H01F 13/12; H01T 15/00
(Continued)

(56) References Cited

U.S. PATENT DOCUMENTS 3,885,541 A * 5/1975 Hufton ..... F02P 1/086 123/598
5,140,970 A * 8/1992 Akaki ..... F02P 3/053 123/620
(Continued)

FOREIGN PATENT DOCUMENTS

JP 2000-199470 7/2000
JP 2002-039042 2/2002
JP B2-5631638 11/2014

*Primary Examiner* — Mahmoud Gimie
(74) *Attorney, Agent, or Firm* — Nixon & Vanderhye P.C.

(57) ABSTRACT

An ignition apparatus for an internal combustion engine which is capable of having a high-degree of ignition performance and being reduced in size is provided. The ignition apparatus includes the spark plug mounted in an end of the plug hole formed in the internal combustion engine, the first ignition coil, the second ignition coil, and the control portion. The first ignition coil includes the primary coil and the secondary coil and has a secondary side electrically connected to the spark plug. The second ignition coil includes the primary coil and the secondary coil and is connected to the spark plug in parallel to the first ignition coil. The control portion controls energization of the first ignition coil and the second ignition coil. The secondary voltage developed at the second ignition coil is lower in level than that developed at the first ignition coil. The control portion works to create the secondary voltage at the first ignition coil and then create the secondary voltage at the second ignition coil to have the spark plug continue to discharge.

9 Claims, 4 Drawing Sheets

(51) Int. Cl.

| | |
|---|---|
| ***F02P 15/08*** | (2006.01) |
| ***F02P 15/00*** | (2006.01) |
| ***H01F 38/12*** | (2006.01) |
| ***F02P 9/00*** | (2006.01) |
| *H01T 15/00* | (2006.01) |

(52) U.S. Cl.
CPC ..... *F02P 15/08* (2013.01); *F02P 15/10* (2013.01); *H01F 38/12* (2013.01); *H01T 15/00* (2013.01)

(58) Field of Classification Search
USPC ..... 123/634, 636, 640, 621, 622, 641
See application file for complete search history.

(56) References Cited

U.S. PATENT DOCUMENTS

| | | | | | |
|---|---|---|---|---|---|
| 5,193,515 | A * | 3/1993 | Oota | F02P 3/0892 | 123/604 |
| 5,197,449 | A * | 3/1993 | Okamoto | F02P 3/0435 | 123/622 |
| 7,121,270 | B1 * | 10/2006 | Plotnikov | F02P 15/10 | 123/604 |
| 2012/0186568 | A1 * | 7/2012 | Steinberger | F02P 13/00 | 123/634 |
| 2012/0186569 | A1 * | 7/2012 | Shimakawa | F02P 15/10 | 123/644 |
| 2014/0360476 | A1 * | 12/2014 | Huberts | F02P 9/002 | 123/609 |
| 2015/0152832 | A1 * | 6/2015 | Desai | F02P 9/002 | 123/625 |
| 2017/0022961 | A1 * | 1/2017 | Toriyama | F02P 3/08 | |
| 2017/0284356 | A1 * | 10/2017 | Takeda | F02P 3/05 | |

* cited by examiner

IGTA
H
L

IGTB
H
L

I1A
X

I1B
X

I2

IGNITION APPARATUS FOR INTERNAL COMBUSTION ENGINE

This application is the U.S. national phase of International Application No. PCT/JP2016/063915 filed May 10, 2016 which designated the U.S. and claims priority to JP Patent Application No. 2015-096215 filed May 11, 2015, the entire contents of each of which are hereby incorporated by reference.

TECHNICAL FIELD

The invention is generally relates to an internal combustion engine ignition apparatus for use in igniting an internal combustion engine.

BACKGROUND ART

A various types of ignition apparatuses have been proposed in order to improve ignition performance to ignite fuel. For instance, Japanese Patent No. 5631638 teaches an internal combustion engine ignition apparatus which is equipped with a case in which the same type of two ignition coils are disposed, a connector which supplies an external electrical power and signals, and a high-voltage output terminal which delivers a high voltage to a spark plug. In the ignition apparatus, the high-voltage terminal delivers a combination of outputs from the two ignition coils to the spark plug. A coil-storing portion of the case is arranged outside a plug hole formed in an upper portion of the internal combustion engine.

SUMMARY OF THE INVENTION

Problem to be Solved by the Invention

The above internal combustion ignition apparatus is required to have the coil-storing portion disposed outside the plug hole formed in each cylinder of the internal combustion engine. The coil-storing portion, however, has the same types of two rectangular coils disposed therein, which results in an increased size thereof. This, therefore, leads to a problem that it is difficult for the coil-storing portions to be arranged for a plurality of cylinders disposed closer to each other within a narrow mounting space for the internal combustion engine without any physical interference therebetween.

In view of the above situations, it is an object of the invention to provide an internal combustion engine ignition apparatus which improves a high degree of ignition performance and achieves downsizing thereof.

Means for Solving the Problem

According to one aspect of the invention, there is provided an ignition apparatus for an internal combustion engine which comprises: (a) a spark plug which is to be mounted in an end portion of a plug hole formed in an internal combustion engine; (b) a first ignition coil which is equipped with a primary coil and a secondary coil and has a secondary side thereof electrically connected to the spark plug; (c) a second ignition coil which is equipped with a primary coil and a secondary coil and connected to the spark plug in parallel to the first ignition coil; and (d) a control portion which control energization of the first ignition coil and the second ignition coil. A secondary voltage developed at the second ignition coil is lower than that developed at the first ignition coil. The control portion works to create the secondary voltage at the first ignition coil and then create the secondary voltage at the second ignition coil to have the spark plug continue to discharge.

The first ignition coil and the second ignition coil are connected to the spark plug in parallel to each other. The second ignition coil is designed to create the secondary voltage lower in level than that developed at the first ignition coil. Usually, a high voltage is required for the spark plug to start discharging, but once the discharge is started, the voltage required to continue the discharging will be lower than that required to initiate the discharge. Accordingly, after the secondary voltage is induced at the first ignition coil which is higher in secondary voltage to initiate a discharge, the secondary voltage is induced at the second ignition coil which is lower in secondary voltage to achieve the continuation of the discharge. The continuation of the discharge in this way enhances the ability to ignite fuel. The secondary voltage developed at the second ignition coil is set lower than at the first ignition coil, thereby enabling the second ignition coil to be reduced in size as compared with the first and second ignition coils are designed to develop the same level of the secondary voltage. This establishes a high-degree of ignition performance and downsizing of the ignition apparatus.

BRIEF DESCRIPTION OF THE DRAWINGS

FIG. 3(*b*) is a time chart which demonstrate a drive signal for a second switch.

FIG. 3(*c*) is a time chart which demonstrates primary current in a first ignition coil.

FIG. 3(*d*) is a time chart which demonstrates primary current in a second ignition coil.

FIG. 3(*e*) is a time chart which demonstrates secondary current in a first ignition coil and a second ignition coil.

EMBODIMENT FOR CARRYING OUT THE INVENTION

Figure 1:
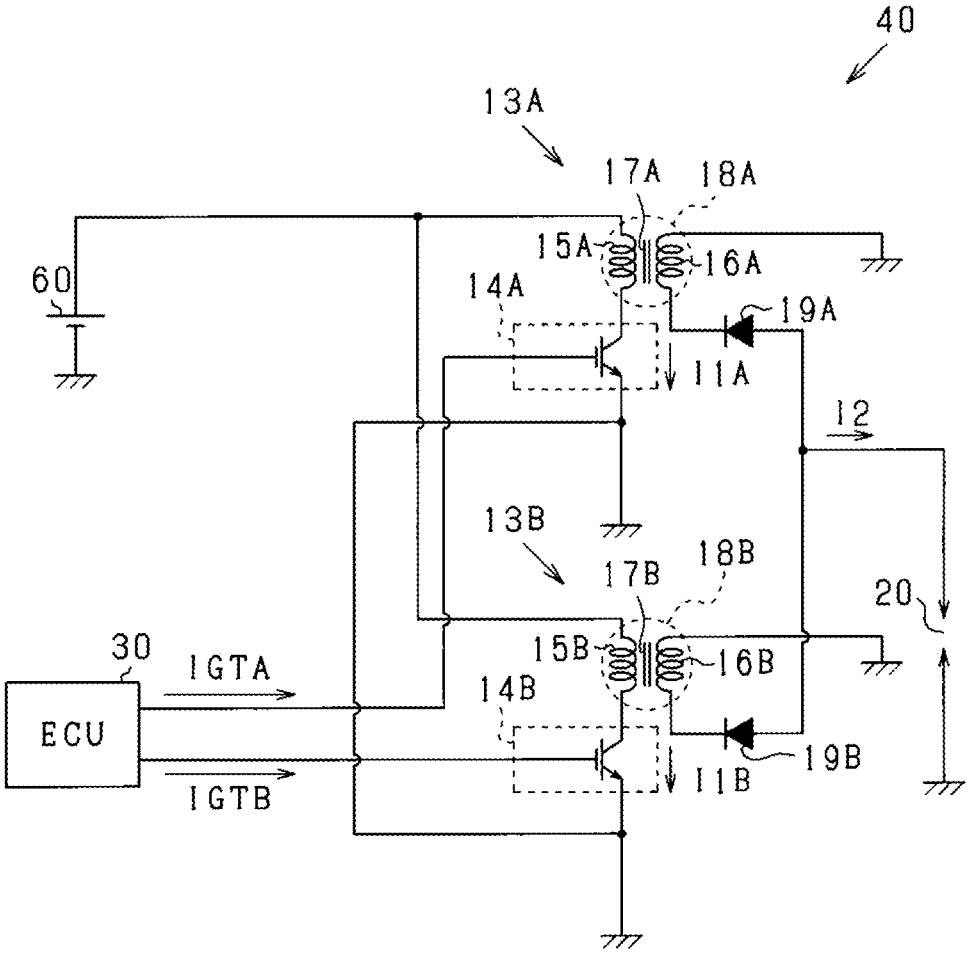
FIG. 1 is a circuit diagram which illustrates an electrical structure of an ignition apparatus for an internal combustion engine according to an embodiment.

An embodiment of the ignition apparatus 40 for internal combustion engines will be described below with reference to the drawings. The electrical structure of the ignition apparatus 40 will first be discussed with reference to FIG. 1.

The ignition apparatus 40 is equipped with the first ignition portion (i.e., a first ignition circuit) 13A, the second ignition portion (i.e., a second ignition circuit) 13B, the spark plug 20, and the ECU 30. The ignition apparatus 40 is connected to the battery 60 which delivers a direct-current power to the ignition apparatus 40. A direct-current voltage at the battery 60 is 12V to 24V.

The first ignition portion 13A is equipped with the first ignition coil 18A, the first switch 14A, and the diode 19A.

IGBT (Insulated Gate Bipolar Transistor) is used as the first switch 14A, but another type of transistor such as a MOSFET may be used.

The first ignition coil 18A includes the primary coil 15A, the secondary coil 16A, and the iron core 17A. The primary coil 15A has a first end connected to a positive terminal of the battery 60 and a second end connected to a collector of the first switch 14A. The first switch 14A has an emitter connected to ground. The first switch 14A has a gate connected to the ECU 30. The secondary coil 16A has a first end connected to ground and a second end connected to a center electrode of the spark plug 20 through the diode 19A which works to avoid the preignition. The diode 19A is connected at a cathode thereof to the second end of the secondary coil 16A and at an anode thereof to the spark plug 20. The number of turns of the secondary coil 16A is greater than that of the primary coil 15A.

The first switch 14A is turned on or off in response to a drive signal transmitted from the ECU 30. When the first switch 14A is turned on, the voltage at the battery 60 is applied to the primary coil 15A, so that the primary current I1A flows through the primary coil 15A, thereby causing magnetic energy to be stored in the primary coil 15A. Afterwards, when the first switch 14A is turned off, it blocks a flow of the primary current I1A through the primary coil 15A, so that mutual induction between the primary coil 15A and the secondary coil 16A creates a secondary voltage at the secondary coil 16A, thereby generating an electric discharge in the spark plug 20. This causes the secondary current I2 to flow through the secondary coil 16A. The secondary voltage developed at the secondary coil 16A is applied between the center electrode and the ground electrode of the spark plug 20. The secondary voltage at the secondary coil 16A is a high voltage of, for example, 30 kV which is high enough to initiate the discharge between the electrodes of the spark plug 20. Note that a direction in which the current flows from the positive terminal of the battery 60 to the primary coils 15A and 15B is expressed as positive, and arrows in the drawings represent a direction in which the positive current flows.

The second ignition portion 13B is equipped with the second ignition coil 18B, the second switch 14B, and the diode 19B and, thus, has the same structure as that of the first ignition portion 13A. The second ignition coil 18B includes the primary coil 15B, the secondary coil 16B, and the iron core 17B and, thus, has the same structure as that of the first ignition coil 18A.

The secondary coil 16A and the secondary coil 16B are connected in parallel to each other to the spark plug 20. The primary coil 15A and the primary coil 15B are connected in parallel to each other to the battery 60. The diodes 19A and 19B are disposed so that the secondary current I2 flowing through the secondary coil 16A and the secondary current I2 flowing through the secondary coil 16B are oriented in the same direction. The first ignition coil 18A and the second ignition coil 18B are engineered to apply the secondary voltage to the spark plug 20 with the same polarity.

The ratio NB of the number of turns N2B of the secondary coil 16B to the number of turns N1B of the primary coil 15B is set smaller than the ratio NA of the number of turns N2A of the secondary coil 16A to the number of turns N1A of the primary coil 15A. In other words, the first ignition coil 18A and the second ignition coil 18B are designed so that the secondary voltage, as developed by the second ignition coil 18B, is lower than the secondary voltage developed by the first ignition coil 18A.

Usually, starting to develop an electrical discharge in the spark plug 20 requires application of high voltage to the spark plug 20. The voltage required to create the discharge once the spark plug 20 has started to discharge is low. In other words, it is possible for the spark plug 20 to continue to produce the discharge only by applying the level of voltage thereto which is lower than that required to start the discharge. For instance, a voltage of approximately 30 kV is required to start the discharge, while a voltage of approximately several kV to 10 kV is required to continue to produce the discharge.

In the case of an ignition apparatus equipped with two ignition coils for improving the ability to ignite fuel in internal combustion engines, one of the two ignition coils may be used only to continue to produce the discharge in order to decrease the secondary voltage developed at the one of the two ignition coils to a level required to continue to produce the discharge. This enables the one of the ignition coils to have a decreased number of turns as compared with when the secondary voltages at both the ignition coils are set to a level required to start developing the discharge, thereby making it possible to lower the voltage resistance (i.e., withstand voltage) of the ignition coils. This also enable the thickness of coating on windings of the ignition coils or the insulating distance to be decreased, thereby permitting the ignition coil only used to continue to produce the discharge to be reduced in size thereof. The insulating distance is an interval between each of the ignition coils 18A and 18B and another component, such as a case or an engine, or the thickness of an insulating material disposed between conductors.

As apparent from the above discussion, the voltage resistance (i.e., withstand voltage) of the ignition apparatus 40 may be lowered by using only one of the two ignition coils to continue to produce the discharge as compared with when both the ignition coils are capable of starting to develop the discharge, thereby enabling the ignition apparatus 40 to be reduced in size thereof. Usually, a space around the internal combustion engine for mounting the ignition apparatus 40 is narrow. The ease with which the ignition apparatus 40 is mounted is, therefore, improved by reducing the size of the ignition apparatus 40.

The ignition apparatus 40 is, therefore, designed to use the first ignition coil 18A mainly for starting developing an electrical discharge and also use the second ignition coil 18B for continuing to produce the discharge. Specifically, the turn ratio NB of the second ignition coil 18B is selected to be lower than or equal to one-third (⅓) of the turn ratio NA of the first ignition coil 18A to set the secondary voltage at the second ignition coil 18B lower than or equal to one-third of that at the first ignition coil 18A, for example, to approximately 10 kV. Additionally, the voltage resistance (i.e., withstand voltage) of the second ignition coil 18B is also set lower than or equal to one-third (⅓) of that of the first ignition coil 18A. This enables the second ignition coil 18B to be reduced in size, which results in a decrease in overall size of the ignition apparatus 40.

The ECU 30 (i.e., a control portion) is mainly made of a microcomputer equipped with a CPU, a ROM, a RAM, and an I/O. The ECU 30 outputs drive signals to the gates of the first switch 14A and the second switch 14B using programs stored in the ROM and outputs from a variety of sensors which represent operating conditions. In this way, the ECU 30 control energization of the first ignition coil 18A and the second ignition coil 18B to control the discharge developed by the spark plug 20. Control tasks executed by the ECU 30 will be described later in detail.

Figure 2:
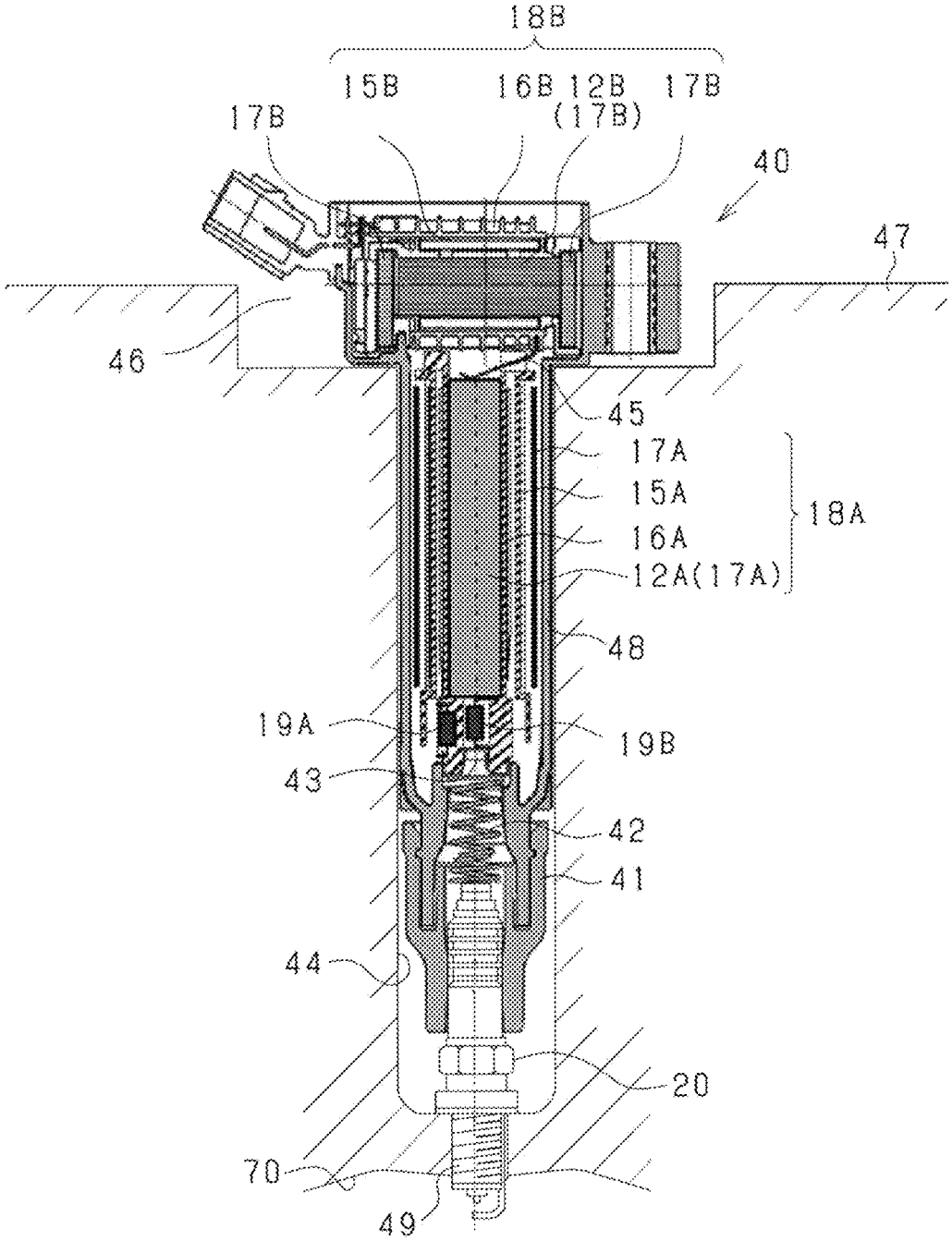
FIG. 2 is a sectional view which illustrates a mechanical structure of an ignition apparatus for an internal combustion engine which is mounted in a plug hole of the internal combustion engine according to an embodiment.

The mechanical structure of the ignition apparatus 40 will be described below with reference to FIG. 2. FIG. 2 is a sectional view which illustrates the ignition apparatus 40 which is installed in the plug hole 44 formed in the internal combustion engine 47 using a fastener, not shown.

The plug hole 44 is a circular cylindrical deep hole which extends from an outer surface of the internal combustion engine 47, i.e., the bottom of the housing recess 46 in a cylinder head or a head cover toward the combustion chamber 70. The spark plug 20 is mounted in the lower end of the plug hole 44. Specifically, the threaded hole 49 is formed in the bottom of the plug hole 44 and extends into the combustion chamber 70 of the internal combustion engine 47. The spark plug 20 is mounted in the threaded hole 49 to have the ground electrode and the center electrode extending into the combustion chamber 70.

The first ignition coil 18A which is relatively higher in secondary voltage is located inside the plug hole 44 and arranged in an upper portion of the spark plug 20, while the secondary voltage which is relatively lower in secondary voltage is located outside the plug hole 44 and arranged above the first ignition coil 18A, specifically, in the housing recess 46 formed just above the plug hole 44.

In the case where the first ignition coil 18A which is higher in secondary voltage is disposed outside the plug hole 44, the voltage at wire which is disposed in the plug hole 44 and connects the second ignition coil 18B and the spark plug 20 becomes high, thus resulting in a difficulty in establishing electrical insulation therefor. The electrical insulation from the spark plug 20 may, therefore, be facilitated by arranging the second ignition coil 18B which is lower in secondary voltage outside the plug hole 44.

The first ignition coil 18A is made of a cylindrical ignition coil (i.e., a stick coil) formed by the secondary coil 16A wound around the cylindrical center core 12A of the iron core 17A, the primary coil 15A wound outside the secondary coil 16A, and the iron core 17A disposed outside the primary coil 15A as an outer shell. The first ignition coil 18A is formed in a cylindrical solid shape contoured to conform with the cylindrical shape of the plug hole 44 and has a circular traverse section extending perpendicular to the length of the plug hole 44.

The second ignition coil 18B is made up of the primary coil 15B wound around the center core 12B of the iron cores 17B, the secondary coil 16B wound outside the primary coil 15B, and the closed magnetic circuit iron cores 17B fit on the outer periphery thereof. The center core 12B is a core which has a rectangular section perpendicular to the length of the plug hole 44.

The wire 45 which extends from the secondary coil 16B of the second ignition coil 18B is in placed in contact with an upper end of the center core 12A of the first ignition coil 18A. The cathode of the diode 19B is in contact with the lower end of the center core 12A. The cathode of the diode 19A is in contact with the secondary coil 16A of the first ignition coil 18A. The anodes of the diodes 19A and 19B are connected to the gap-shaped high-voltage terminal 43. The spring terminal 42 is connected at an upper end thereof to the lower end of the high-voltage terminal 43.

The first ignition coil 18A, the second ignition coil 18B, the diodes 19A and 19B, the high-voltage terminal 43, and the spring terminal 42 are disposed in the insulating case 48. The first ignition coil 18A, the second ignition coil 18B, and the diodes 19A and 19B are firmly retained by resin. The insulating case 48 includes a circular cylindrical portion corresponding to the shape of the plug hole 44 and a rectangular portion (i.e., a housing) corresponding to the shape of the second ignition coil 18B, and is secured to the housing recess 46 using a fastening mechanism, not shown. The rectangular portion of the insulating case 48 is arranged in an open portion above the plug hole 44. The cylindrical portion of the insulating case 48 has a lower end portion which is thinner than an upper portion thereof. The spring terminal 42 is press-fit in the thin portion of the cylindrical portion. The first ignition coil 18A and the diodes 19A and 19B are arranged in the upper cylindrical portion above the thin portion. The second ignition coil 18B is disposed in the upper portion of the insulating case 48 in a cuboid shape (i.e., a section of the core of the second ignition coil extending perpendicular to the length of the plug hole 44 is rectangular).

The lower end of the cylindrical portion of the insulating case 48 is opened. The cylindrical buffer member 41 is joined to the lower end of the insulating case 48. The upper portion of the spark plug 20 is inserted into the buffer member 41. The spring terminal 42 is disposed just above the spark plug 20. The spring terminal 42 is compressed to establish connection of the second ends of the secondary coils 16A and 16B to the positive pole of the spark plug 20 through the diodes 19A and 19B, the high-voltage terminal 43, and the spring terminal 42. The buffer member 41 is made of synthetic resin.

Figures 3A, 3B, 3C, 3D, 3E:
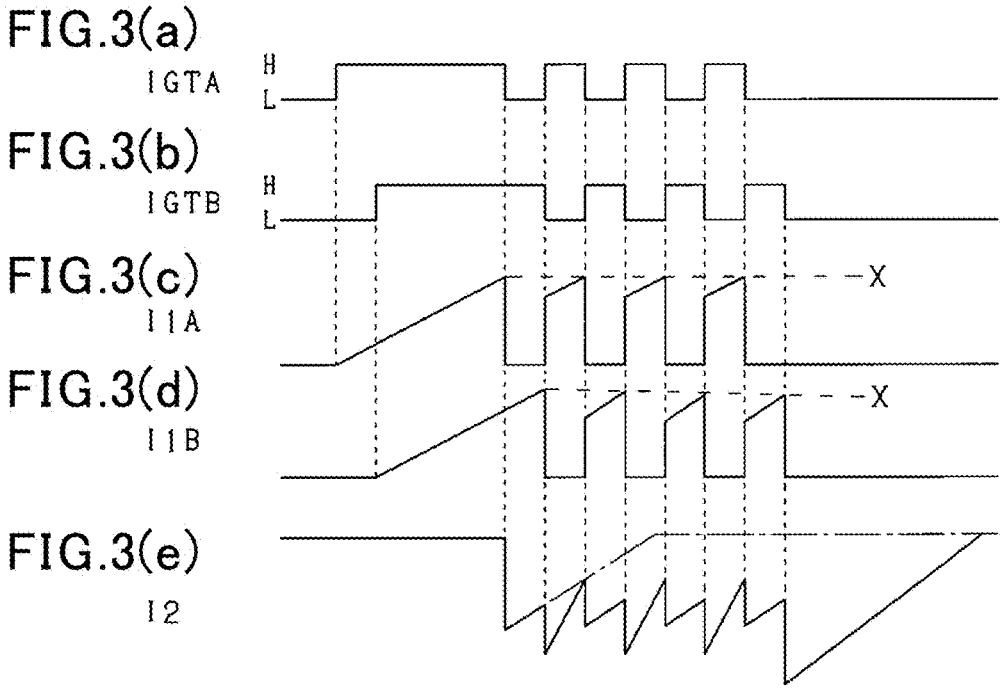
FIG. 3(*a*) is a time chart which demonstrate a drive signal for a first switch.

Next, a discharge control operation of the spark plug 20 achieved by the ECU 30 will be described below with reference to FIGS. 3(*a*) to 3(*e*). FIGS. 3(*a*) and 3(*b*) represent drive signals IGTA and IGTB for the first switch 14A and the second switch 14B, respectively. When the drive signal IGTA and TGTB are at the high level, the first switch 14A and the second switch 14B are in the on-state. Alternatively, when the drive signals IGTA and IGTB are at the low level, the first switch 14A and the second switch 14B are in the off-state. FIGS. 3(*c*) and 3(*d*) represent the primary current I1A and the primary current I1B, respectively. A solid line in FIG. 3(*e*) indicates the secondary current I2. The secondary current I2 flows in a direction opposite that, as indicated by the arrows in FIG. 1, so that it has a negative in this embodiment. In FIG. 3(*e*), a negative direction is defined as a direction in which the secondary current I2 increases.

The drive signals IGTA and IGTB are each made up of a first pulse and a plurality of second pulses following the first pulse. An interval between the first pulse and the second pulse following the first pulse and an interval between adjacent two of the second pulses are shorter than an interval (i.e., an output cycle) at which the first pulses are outputted in sequence. The widths of the first pulses and the second pulses are selected to bring the primary currents I1A and I1B to predetermined target values X, respectively. The target values X are selected to produce desired levels of the secondary voltage when the off-operations of the first switch 14A and the second switch 14B are made. A ratio of the width of the first pulses to the width of the second pulses is selected so that the width of the second pulses are set to be approximately one-fifth (1/5) or one-twelfth (1/20) of the width of the first pulses.

First, the ECU 30 outputs the first pulse to the first switch 14A to turn on the first switch 14A. This causes the primary current I1A to flow through the primary coil 15A. Subsequently, after a lapse of a given period of time since the first pulse was transmitted to the first switch 14A, the ECU 30 outputs the first pulse to the second switch 14B. This causes the primary current I1B to flow through the primary coil 15B.

After a given period of time passes, the ECU 30 changes the drive signal IGTA to the low level, thereby blocking the flow of the primary current I1A, so that the secondary voltage is induced at the secondary coil 16A and then applied to the spark plug 20. The spark plug 20 then starts to discharge, so that the secondary current I2 flows from the secondary coil 16A.

Subsequently, after a given period of time passes, the ECU 30 changes the drive signal IGTB to the low level and also changes the drive signal IGTA to the high level. This blocks the flow of the primary current I1B, so that the secondary voltage is induced at the secondary coil 16B. When the secondary voltage reaches a discharge voltage, the second current I2 flows from the secondary coil 16B. The changing of the drive signal IGTA to the high level cause the primary current I1A to flow through the primary coil 15A. The spark plug 20 has already been discharging at a level lower than that required to start discharging. The application of a discharge voltage which is lower than the secondary voltage developed at the secondary coil 16A to the spark plug 20 will, therefore, cause the spark plug 20 to continue to discharge.

Subsequently, after a given period of time passes, the ECU 30 changes the drive signal IGTA to the low level and also changes the drive signal IGTB to the high level. This blocks the flow of the primary current I1A, so that the secondary voltage created at the primary coil 15A is applied to the spark plug 20 to further continue to discharge.

Afterwards, the ECU 30 alternately turns on and off the first switch 14A and the second switch 14B to have the spark plug 20 continue to discharge for a given period of time. Specifically, the ECU 30 generates the second voltage at the first ignition coil 18A to start discharging, and then develops the second voltage alternately at the first ignition coil 18A and the second ignition coil 18B to continue to discharge in the spark plug 20. In this period of time, the voltage of the same polarity continues to be applied to the spark plug 20, thereby ensuring the stability in discharging at the same polarity.

After having the spark plug 20 continue to discharge for a given period of time and then changes the drive signals IGTA and IGTB to the low level to turn off both the first switch 14A and the second switch 14B. This causes the secondary voltages, as developed at the secondary coils 16A and 16B, to decrease to zero, thereby terminating the discharging operation of the spark plug 20. At this time, the secondary current I2 will flow from both the secondary coil 16A and the secondary coil 16B, thereby causing the secondary current I2 which is larger than that when the spark plug 20 is continuing to discharge to flow, after which the secondary voltage drops to zero.

A chain line in FIG. 3(*e*) represents the secondary current I2 in the case where the first switch 14A and the second switch 14B are not alternately turned on or off after the discharge is started using the first ignition coil 18A. In this case, the secondary current I2 attenuates, a duration thereof is short, and a discharge duration is short as compared with this embodiment. In this embodiment, the first ignition coil 18A and the second ignition coil 18B are alternately used to increase the discharge duration to enhance the ignition performance even in internal combustion engines, such as lean-burn engines, in which fuel is difficult to ignite.

The turn ratio NB of the second ignition coil 18B is set smaller than the turn ratio NA of the first ignition coil 18A, so that the inductance of the secondary coil 16B is smaller than that of the secondary coil 16A. This causes the secondary current I2 flowing from the secondary coil 16B to be greater in value than the secondary current I2 flowing from the secondary coil 16A and also causes a rate of decrease in the secondary current I2 flowing from the secondary coil 16B to be greater than that of the secondary current I2 flowing from the secondary coil 16A. In other words, the secondary current I2 flowing from the secondary coil 16B decreases at a higher rate than that at which the secondary current I2 flowing from the secondary coil 16A decreases.

The above described embodiment offers the following beneficial advantages.

The first ignition coil 18A at which the secondary voltage is higher is used to start the discharging operation. The continuing of the discharging operation is achieved by cyclically operating the second ignition coil 18B at which the secondary voltage is lower and the first ignition coil 18A. The continuing of the discharging operation after the start of the discharging operation in the above way serves to keep the secondary current at a high level, thereby ensuring the stability in producing a spark current to enhance the ignition performance. The secondary voltage at the second ignition coil 18B is lower than that at the first ignition coil 18A, thereby enabling the second ignition coil 18B to be reduced in size as compared with when the secondary voltages developed at the ignition coils 18A and 18B are substantially at the same level. This achieves high ignition performance and downsizing of the ignition apparatus 40.

The first ignition coil 18A is disposed inside the plug hole 44, while the second ignition coil 18B is mounted outside the plug hole 44 above the first ignition coil 18A, thereby effectively using a space in the plug hole 44 and also improving the efficiency in arranging the ignition coils 18A and 18B. This provides the easy-to-install structure of the ignition apparatus 40.

The first ignition coil 18A at which the secondary voltage is higher in level is disposed inside the plug hole 44, while the second ignition coil 18B at which the secondary voltage is lower in level is arranged outside the plug hole 44, thereby facilitating the design for insulation of the second ignition coil 18B in the plug hole 44.

The first ignition coil 18A is designed in a cylindrical shape identical with the shape of typical plug holes, thereby enhancing the efficiency in arranging the first ignition coil 18A in the plug hole 44. The second ignition coil 18B is designed to be cuboid, thereby facilitating the ease with which the second ignition coil 18B is disposed outside the plug hole 44 above the first ignition coil 18A.

After start of the discharge, the secondary voltage is developed alternately at the first ignition coil 18A and the second ignition coil 18B to achieve the continuing of the discharge, thereby improving the ignition performance of the ignition apparatus 40.

The first ignition coil 18A and the second ignition coil 18B are so designed as to apply the secondary voltages having the same polarity to the spark plug 20. This causes the spark plug 20 to continue to discharge at the same polarity, thereby ensuring the stability in the discharging operation of the spark plug without dropping the secondary voltage.

The secondary coil 16B of the second ignition coil 18B is connected to the center core 12A of the first ignition coil 18A. The lower end of the center core 12A is connected to the spark plug 20 through the diode 19B. This eliminates the need for wire extending from the secondary coil 16B of the second ignition coil 18B to the spark plug 20, which enables the structure of the ignition apparatus 40 to be simplified or reduced in size.

Usually, the voltage required for the spark plug 20 to continue to discharge in internal combustion engines is approximately one-third of that required to initiate the discharge. It is, therefore, possible to set the withstand voltage of the second ignition coil 18B working to develop the voltage for continuing the discharging operation to be one-third or less of that of the first ignition coil 18A working to create the voltage for initiating the discharging operation. This enables the second ignition coil 18B to have a decreased insulation distance, a decreased thickness of coating, or a reduced size as compared with the first ignition coil 18A.

Other Embodiments

The first ignition coil 18A may be of any shape, for example, cuboid other than cylindrical shape as long as it can be disposed in the plug hole 44. The second ignition coil 18B may be shaped to have a cross-section which extends perpendicular to the length of the plug hole 44 and is of any shape other than rectangular as long as it can be arranged above the first ignition coil 18A. For example, the second ignition coil 18B may be shaped to have a semi-circular cross-section which extends perpendicular to the length of the plug hole 44 or a rectangular cross-section which extends parallel to the length of the plug hole 44.

Figure 4:
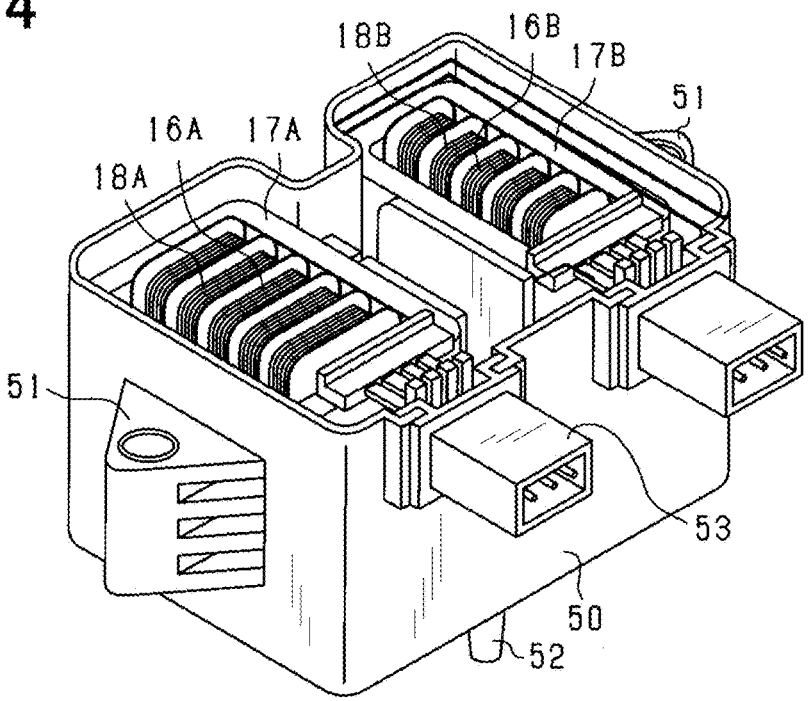
FIG. 4 is a view which illustrates structures of modified forms of a first and a second ignition coil.

The first ignition coil 18A may not be disposed inside the plug hole 44. The first ignition coil 18A and the second ignition coil 18B which is lower in secondary voltage may be, as illustrated in FIG. 4, of a rectangular parallelepiped shape. In this embodiment, the size of the first ignition coil 18A is twice or more that of the second ignition coil 18B. The first ignition coil 18A and the second ignition coil 18B are disposed in the rectangular parallelepiped housing case 50 and retained by resin. The housing case 50 has the fasteners 51, the high-voltage output 52, and the connectors 53 formed thereon. The housing case 50 is secured to the cylinder head of the internal combustion engine 47 using the fasteners 51 with the high-voltage output 52 extending toward the plug hole 44. The battery 60 and the ECU 30 are joined to the connectors 53. The secondary voltages, as developed by the first ignition coil 18A and the second ignition coil 18B are delivered to the spark plug 20 through the high-voltage output 52. These arrangements permit the size of the housing case 50 to be reduced as compared with conventional structures. This enables the housing cases 50 to be mounted for respective cylinders without any interference between the adjacent housing cases 50.

The first switch 14A and the second switch 14B may not be mounted in the coils, but may be installed in the ECU 30 for further downsizing them.

Figure 5:
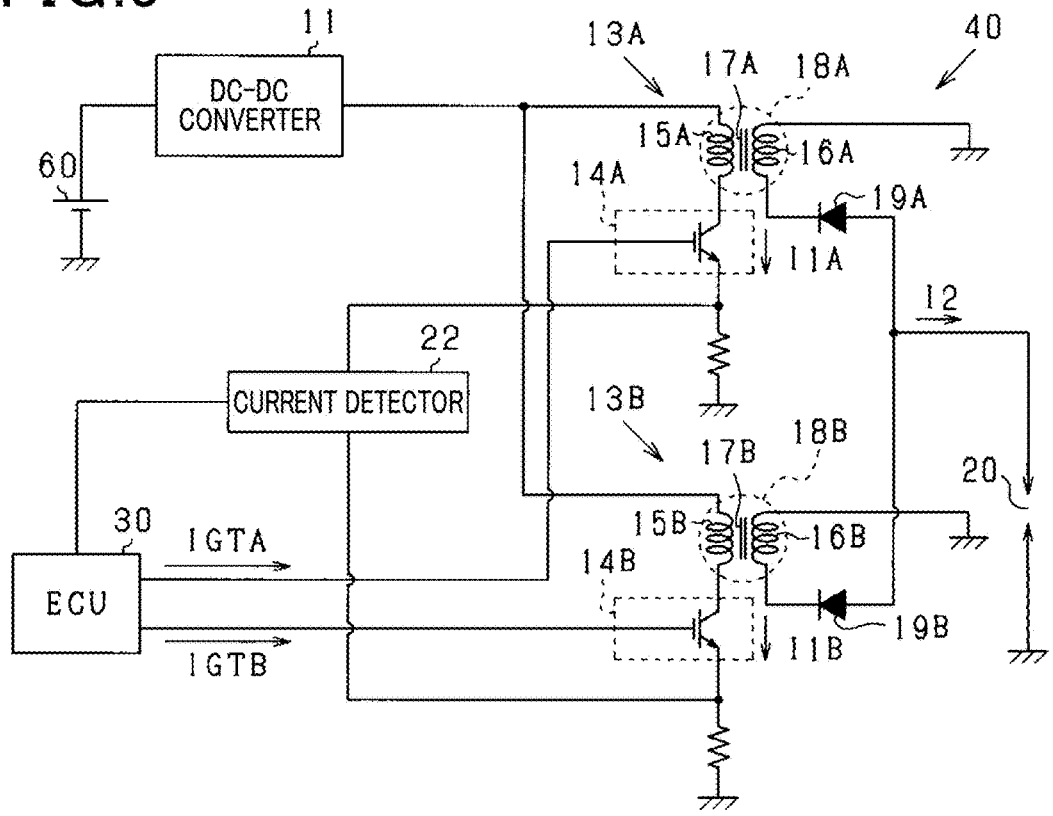
FIG. 5 is a circuit diagram which illustrates an electrical structure of an ignition apparatus for an internal combustion engine according to another embodiment.

The ignition apparatus 40 may be, as illustrated in FIG. 5, equipped with the DC-DC converter 11 connected between the first ends of the primary coils 15A and 15B and the battery 60. The DC-DC converter 11 works to step-up the dc voltage of the battery 60 and apply it to the primary coils 15A and 15B, thereby increasing the magnetic energy inputted to the first ignition coil 18A and the second ignition coil 18B in a short period of time.

The ignition apparatus 40 may be, as illustrated in FIG. 5, equipped with the current detecting circuit 22 disposed between the emitters of the first switch 14A and the second switch 14B and the ECU 30. The current detecting circuit 22 is made of an electronic circuit such as a comparator and works to measure the primary currents I1A and I1B flowing through the primary coils 15A and 15B and output value of the primary currents I1A and I1B to the ECU 30. The ECU 30 may designed to monitor whether energization or deenergization operations are being correctly performed or not and turn off the first switch 14A and the second switch 14B under given conditions when the primary currents I1A and I1B have exceeded a limited value, that is, have become overcurrents, for protecting each switch or each coil or controlling the current to alternately close the switches.

The setting of the secondary voltage at the second ignition coil 18B to be lower than that at the first ignition coil 18A may not be achieved by decreasing the turn ratio NB of the second ignition coil 18B to be less than the turn ratio NA of the first ignition coil 18A. For instance, the resistance value of the primary coil 15B of the second ignition coil 18B may be selected to be higher than that of the primary coil 15A of the first ignition coil 18A. This causes the primary current I1B in the second ignition coil 18B to be smaller than the primary current I1A in the first ignition coil 18A, so that the secondary voltage at the second ignition coil 18B will be lower than that at the first ignition coil 18A. In the case where the ignition apparatus 40 is equipped with the DC-DC converter 11, the voltage applied to the primary coil 15B of the second ignition coil 18B may be set lower than that applied to the primary coil 15A of the first ignition coil 18A to decrease the secondary voltage developed at the second ignition coil 18B to be lower than that developed at the first ignition coil 18A. The energization duration IGTB may be decreased to lower the value of the blocked current to decrease the developed voltage.

Although the discharging duration of the spark plug 20 is decreased, the secondary voltage may be applied only once by the second ignition coil 18B to the spark plug 20 after the secondary voltage is developed by the first ignition coil 18A. In other words, it is not necessary to alternately apply the secondary voltage to the spark plug 20 using the first ignition coil 18A and the second ignition coil 18B. In this way, the discharging duration may be prolonged to enhance the ignition performance as compared with use of only the first ignition coil 18A. The deenergization operation of the second ignition coil 18B may be performed at the same time as or after that of the first ignition coil 18A provided that a time interval can achieve the continuation of the discharging operation.

Although there is a risk that the stability in discharging operation of the spark plug 20 is deteriorated, the first ignition coil 18A and the second ignition coil 18B may be designed to apply the secondary voltages which are different in polarity from each other to the spark plug 20. The secondary voltages which have the different polarities may be alternately applied to the spark plug 20 to achieve the continuation of the discharging operation.

The invention claimed is:

1. An ignition apparatus for an internal combustion engine comprising:

a spark plug which is to be mounted in an end portion of a plug hole formed in an internal combustion engine;

a first ignition coil which is equipped with a primary coil and a secondary coil and has a secondary side thereof electrically connected to the spark plug;

a second ignition coil which is equipped with a primary coil and a secondary coil and connected to the spark plug in parallel to the first ignition coil; and a control portion which controls energization of the first ignition coil and the second ignition coil, wherein a secondary voltage developed at the second ignition coil is lower than that developed at the first ignition coil, wherein the control portion works to create the secondary voltage at the first ignition coil and then create the secondary voltage at the second ignition coil to have the spark plug continue to discharge, and wherein an inductance of the secondary coil of the second ignition coil is smaller than an inductance of the secondary coil of the first ignition coil.

2. An ignition apparatus for an internal combustion engine as set forth in claim 1, wherein the second ignition coil is disposed outside and above the plug hole.

3. An ignition apparatus for an internal combustion engine as set forth in claim 1, wherein the first ignition coil is disposed inside the plug hole, wherein the second ignition coil is arranged outside the plug hole above the first ignition coil.

4. An ignition apparatus for an internal combustion engine as set forth in claim 3, wherein the first ignition coil is made of a cylindrical ignition coil, and wherein the second ignition coil is made of a rectangular ignition coil which is mounted in a housing provided in an open portion above the plug hole.

5. An ignition apparatus for an internal combustion engine as set forth in claim 1, wherein the control portion develops the secondary voltage at the first ignition coil and then creates the secondary voltage alternately at the first ignition coil and the second ignition coil to achieve continuation of discharging the spark plug.

6. An ignition apparatus for an internal combustion engine as set forth in claim 1, wherein the first ignition coil and the second ignition coil are so designed as to apply the secondary voltages which are identical in polarity, to the spark plug.

7. An ignition apparatus for an internal combustion engine as set forth in claim 3, wherein the first ignition coil is disposed inside the plug hole, the second ignition coil is arranged outside the plug hole above the first ignition coil, a secondary coil of the second ignition coil is connected to a center core of the first ignition coil, and a lower end of the center core is connected to the spark plug through a diode.

8. An ignition apparatus for an internal combustion engine as set forth in claim 1, wherein a withstand voltage of the second ignition coil is set to be lower than or equal to one-third of that of the first ignition coil.

9. An ignition apparatus for an internal combustion engine as set forth in claim 1, wherein a turn ratio of the second ignition coil is set smaller than the turn ratio of the first ignition coil.

* * * * *